US007364801B1

(12) United States Patent
Hazel et al.

(10) Patent No.: US 7,364,801 B1
(45) Date of Patent: Apr. 29, 2008

(54) TURBINE COMPONENT PROTECTED WITH ENVIRONMENTAL COATING

(75) Inventors: Brian Thomas Hazel, West Chester, OH (US); Michael James Weimer, Loveland, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/567,382

(22) Filed: Dec. 6, 2006

(51) Int. Cl.
*B32B 15/04* (2006.01)
*B32B 15/18* (2006.01)
*B32B 15/20* (2006.01)
*F01D 5/14* (2006.01)

(52) U.S. Cl. ..... 428/632; 428/215; 428/335; 428/336; 428/666; 428/678; 428/680; 428/681; 416/229 R; 416/241 R

(58) Field of Classification Search ..... 428/660, 428/666, 678, 680, 681, 652, 215, 220, 335, 428/336, 332, 632; 416/241 R, 248, 223 R, 416/229 R
See application file for complete search history.

(56) References Cited

U.S. PATENT DOCUMENTS 4,451,431 A * 5/1984 Naik ..... 420/588
4,714,624 A * 12/1987 Naik ..... 148/527
5,368,888 A 11/1994 Rigney
5,500,252 A * 3/1996 Meelu ..... 427/376.3
6,139,976 A * 10/2000 Czech et al. ..... 428/610
6,283,715 B1 9/2001 Nagaraj et al.
6,532,657 B1 3/2003 Weimer et al.
6,755,613 B1 6/2004 Schmitz
6,921,251 B2 7/2005 Ackerman et al.
6,926,928 B2 8/2005 Ackerman et al.
6,933,012 B2 8/2005 Das et al.
6,964,791 B2 11/2005 Zhao et al.
2005/0255329 A1 11/2005 Hazel

* cited by examiner

*Primary Examiner*—Michael E. Lavilla
(74) *Attorney, Agent, or Firm*—William Scott Andes; Gary M. Hartman; Domenica N.S. Hartman

(57) ABSTRACT

An environmental coating suitable for use on turbine components, such as turbine disks and turbine seal elements, formed of alloys susceptible to oxidation and hot corrosion. The environmental coating is predominantly a solid solution phase of nickel, iron, and/or cobalt. The coating contains about 18 weight percent to about 60 weight percent chromium, which ensures the formation of a protective chromia ($Cr_2O_3$) scale while also exhibiting high ductility. The coating may further contain up to about 8 weight percent aluminum, as well as other optional additives. The environmental coating is preferably sufficiently thin and ductile to enable compressive stresses to be induced in the underlying substrate through shot peening without cracking the coating.

22 Claims, 2 Drawing Sheets

TURBINE COMPONENT PROTECTED WITH ENVIRONMENTAL COATING

BACKGROUND OF THE INVENTION

The present invention generally relates to turbine components, including the turbine disks and seals of a gas turbine engine. More particularly, this invention relates to turbine disks and seals susceptible to oxidation and hot corrosion, and metallic environmental coatings that are adherent and compatible with disk and seal alloys and capable of providing protection from oxidation and hot corrosion.

The turbine section of a gas turbine engine contains a rotor shaft and one or more turbine stages, each having a turbine disk (or rotor) mounted or otherwise carried by the shaft and turbine blades mounted to and radially extending from the periphery of the disk. Adjacent stages of the turbine are separated by a non-rotating nozzle assembly with vanes that direct the flow of combustion gases through the turbine blades. Seals elements reduce leakage between the rotating and non-rotating (static) components of the turbine section, and channel cooling air flow to the turbine blades and vanes.

Turbine components are formed of superalloy materials in order to achieve acceptable mechanical properties at the elevated temperatures within the turbine section of a gas turbine engine. In particular, turbine airfoil components such as blades and vanes are often formed of equiaxed, directionally solidified (DS), or single crystal (SX) superalloys, while turbine disks and seal elements are typically formed of polycrystalline superalloys that undergo carefully controlled forging, heat treatments, and surface treatments such as peening to achieve desirable grain structures and mechanical properties. Though significant advances in high temperature capabilities of superalloys have been achieved, turbine components located in the hot gas flow path, such as the blades and vanes, are susceptible to damage by oxidation and hot corrosion attack, and are therefore typically protected by an environmental coating and optionally a thermal barrier coating (TBC), in which case the environmental coating is termed a bond coat that in combination with the TBC forms what may be termed a TBC system. Environmental coatings and TBC bond coats widely used on turbine blades and vanes include diffusion aluminide coatings and alloys such as MCrAlX overlay coatings (where M is iron, cobalt and/or nickel, and X is one or more of yttrium, rare earth elements, and reactive elements). The aluminum contents of diffusion aluminide and MCrAlX coatings are sufficient so that a stable and environmentally protective alumina ($Al_2O_3$) scale forms on their surfaces at the operating temperatures of turbine blades and vanes.

As operating temperatures of gas turbine engines continue to increase, the turbine disks and seal elements are also subjected to higher temperatures. As a result, corrosion of the disks/shafts and seal elements has become of concern. Corrosion of turbine disks has been attributed to deposition of solid particles containing metal sulfates or other metal sulfur oxides plus reducing agents, the reaction of the deposited particles with the disk alloy at high temperatures to form reduced metal sulfides covered by air-impermeable fused solid particles, and other corrosive agents including alkaline sulfates, sulfites, chlorides, carbonates, oxides and other corrodant salt deposits. Various corrosion barrier coatings have been investigated to prevent the corrosion of turbine disks from this type of attack. One such approach using layered paints has been hampered by the susceptibility of such paints to spallation during engine operation, believed to be caused by a significant CTE (coefficient of thermal expansion) mismatch between the layered paint and the alloy it protects, which results in high interfacial strains during thermal transient engine conditions. Adhesion of layered paints is likely limited in part by the reliance on mechanical adhesion between the paint and alloy, which can be improved to some extent by grit blasting the surface to be coated prior to depositing the paint. However, spallation remains an impediment to the use of layered paints. Other corrosion barrier coatings have been considered, including aluminides, chromides, and oxides deposited by, for example, metallo organic chemical vapor deposition (MO-CVD), pack silicides, ion implanted aluminum, metal nitrides, and metal carbides. Particular example of these approaches are disclosed in commonly-assigned U.S. Pat. Nos. 6,532,657, 6,921,251, 6,926,928, 6,933,012, and 6,964,791, and commonly-assigned U.S. Patent Application Publication Nos. 2005/0031794 and 2005/0255329.

In addition to corrosion, fatigue testing at elevated temperatures has shown that current disk alloys are also susceptibility to grain boundary oxidation if subjected to higher operating temperatures over extended periods of time. Therefore, in addition to protection from corrosion, higher turbine operating temperatures are necessitating the protection of turbine disks and seals from oxidation. Corrosion barrier coatings are not necessarily effective as oxidation barriers or inhibitors, particularly for extended exposures at high temperatures. Though the MO-CVD aluminide and chromide coatings and metallic carbide and nitride coatings noted above are also potentially capable of serving as barriers to oxidation, these corrosion barrier coatings are believed to have limitations that may render them unsatisfactory for use as protective coatings on turbine disks and seals, such as limited adhesion, CTE mismatch, low volume processing, and chemical interactions with the types of alloys often used to form turbine disks and seals. More particularly, though aluminide coatings exhibit excellent adhesion and corrosion resistance, they can negatively impact the fatigue life of a disk. Chromide coatings also exhibit great adhesion and corrosion resistance, as well as ductility (if the undesirable alpha-chromium phase does not form). However, high processing temperatures required to form chromide coatings make their use difficult on forged parts. Nitride and carbide coatings are generally subject to the same limitations noted above for aluminide and chromide coatings. Finally, oxide coatings (including those applied by MO-CVD) are excellent corrosion barriers and are not detrimental to fatigue properties, but their thermal expansion mismatch with superalloys limits their adhesion.

As such, there is a need for a protective coating material that is suitable for use on turbine disks and seals and resistant to oxidation and corrosion. Such a coating material must also be spall resistant and have an acceptable CTE match and limited mechanical property interaction with disk and seal alloys over extended time at high operating temperatures. In addition, such a coating material would ideally be compatible with the typical processing required for polycrystalline superalloys from which turbine disks and seals are formed.

BRIEF SUMMARY OF THE INVENTION

The present invention provides an environmental coating suitable for use on turbine components, such as turbine disks and turbine seal elements, and particularly those formed of alloys susceptible to oxidation and hot corrosion. The environmental coating has a metallic composition that is adherent, resistant to oxidation and hot corrosion, and both physically and chemically compatible with disk and seal alloys, and therefore capable of providing reliable long-term protection from oxidation and hot corrosion.

The metallic composition of the environmental coating is predominantly a solid solution phase of nickel, iron, and/or cobalt, preferably gamma-Ni matrix, gamma-Co matrix, or a mixture of nickel and cobalt. The composition further contains about 18 weight percent to about 60 weight percent chromium. The lower limit of this range ensures that the environmental coating will form a protective chromia ($Cr_2O_3$) scale while also exhibiting high ductility, good corrosion resistance, and metallurgically bonding to a turbine disk alloy for adhesion. Based on the Ni—Cr phase diagram, the upper limit of the chromium range is to avoid the formation of single-phase alpha chromium. The environmental coating may be as thick as about 250 micrometers, though thicknesses of less than 125 micrometers and more preferably not more than fifty micrometers are preferred to provide a sufficiently thin and ductile coating that enables compressive stresses to be induced in the underlying substrate through shot peening without cracking the environmental coating.

The composition set forth above provides for a very ductile environmental coating with excellent corrosion and oxidation resistance, though with limited strength. A coating with these properties is suitable for protecting a turbine disk or seal, as the coating is not required to support a substantial load during operation, and fatigue performance is essentially determined by the underlying substrate. In particular, the environmental coating does not adversely impact the fatigue properties of the turbine disk or seal, in that its very high ductility resists crack initiation and its excellent environmental resistance drives crack initiation sites internally within the substrates, where grain facets, inclusions, and other common defects are likely to initiate cracking.

The environmental coating as described above can be modified to achieve certain properties. For example, the coating may contain additions of aluminum to enhance corrosion and oxidation resistance. Suitable aluminum levels in the environmental coating are generally in the range of about 4 to about 8 weight percent, in inverse proportion to the chromium content of the coating. For example, a chromium content of about 18 weight percent allows for an aluminum content of up to about 8 weight percent, a chromium content of about 35 weight percent allows for an aluminum content of up to about 6 weight percent, and a chromium content of about 60 weight percent allows for an aluminum content of up to about 4 weight percent. Notably, the aluminum content is intentionally less than that required for the onset of beta-phase NiAl formation (about 13 weight percent aluminum), which is avoided due to the low ductility of beta-phase NiAl that can negatively affect the low cycle fatigue life of a turbine disk. However, up to about 10 volume percent of the beta-NiAl phase is believed to be tolerable, as such a level is not continuous and therefore would not be prone to crack propagation. The aluminum content of the environmental coating is also less than the nominal aluminum content for the gamma prime nickel aluminide phase ($Ni_3Al$), and as a result the coating may contain limited amounts of the gamma prime phase.

The oxidation and/or corrosion resistance of the coating can be promoted by optional modifications to the environmental coating, such as additions of yttrium, hafnium, silicon, lanthanum, cerium, zirconium, magnesium, and rare earth metals. However, hafnium and silicon should be limited to amounts of less than 5 weight percent, whereas the remaining elements in this list should be limited to less than 2 weight percent of the environmental coating.

As noted above, desired properties of the composition are high ductility and excellent corrosion and oxidation resistance, with strength being of secondary concern since load-bearing and fatigue performance are to be determined by the underlying substrate. Nonetheless, the environmental coating may be optionally strengthened with tungsten, molybdenum, tantalum, rhenium, titanium, niobium, vanadium, and/or a platinum group metal (PGM) to improve fatigue resistance. However, additions of these elements are preferably limited to less than 25 weight percent combined, as they can negatively affect corrosion and oxidation resistance, especially tungsten and molybdenum. With such limited additions, strengtheners can enable the environmental coating to bear some of the load during operation of a turbine disk, though maintaining sufficient ductility and environmental resistance to avoid surface-initiated fatigue cracking.

In view of the above, it can be seen that a significant advantage of this invention is that the environmental coating provides protection from oxidation and corrosion in a form suitable for use on turbine components, and particularly on turbine disks and seals formed of polycrystalline superalloys. The environmental coating has a composition whose CTE closely matches that of superalloys widely used for turbine disks and sealing elements, and exhibits limited mechanical property interaction with such superalloys over extended time at temperature. Furthermore, the material of the environmental coating is capable of being metallurgically bonded to such superalloys to be highly resistant to spalling. Finally, the environmental coating is compatible with processing typically associated with polycrystalline superalloys used to form turbine disks and sealing elements. In particular, the ductility and limited thickness of the environmental coating permits the surface of the component to be peened to induce a residual compressive stress in the turbine disk or seal, without cracking the environmental coating.

Other objects and advantages of this invention will be better appreciated from the following detailed description.

DETAILED DESCRIPTION OF THE INVENTION

Figure 1:
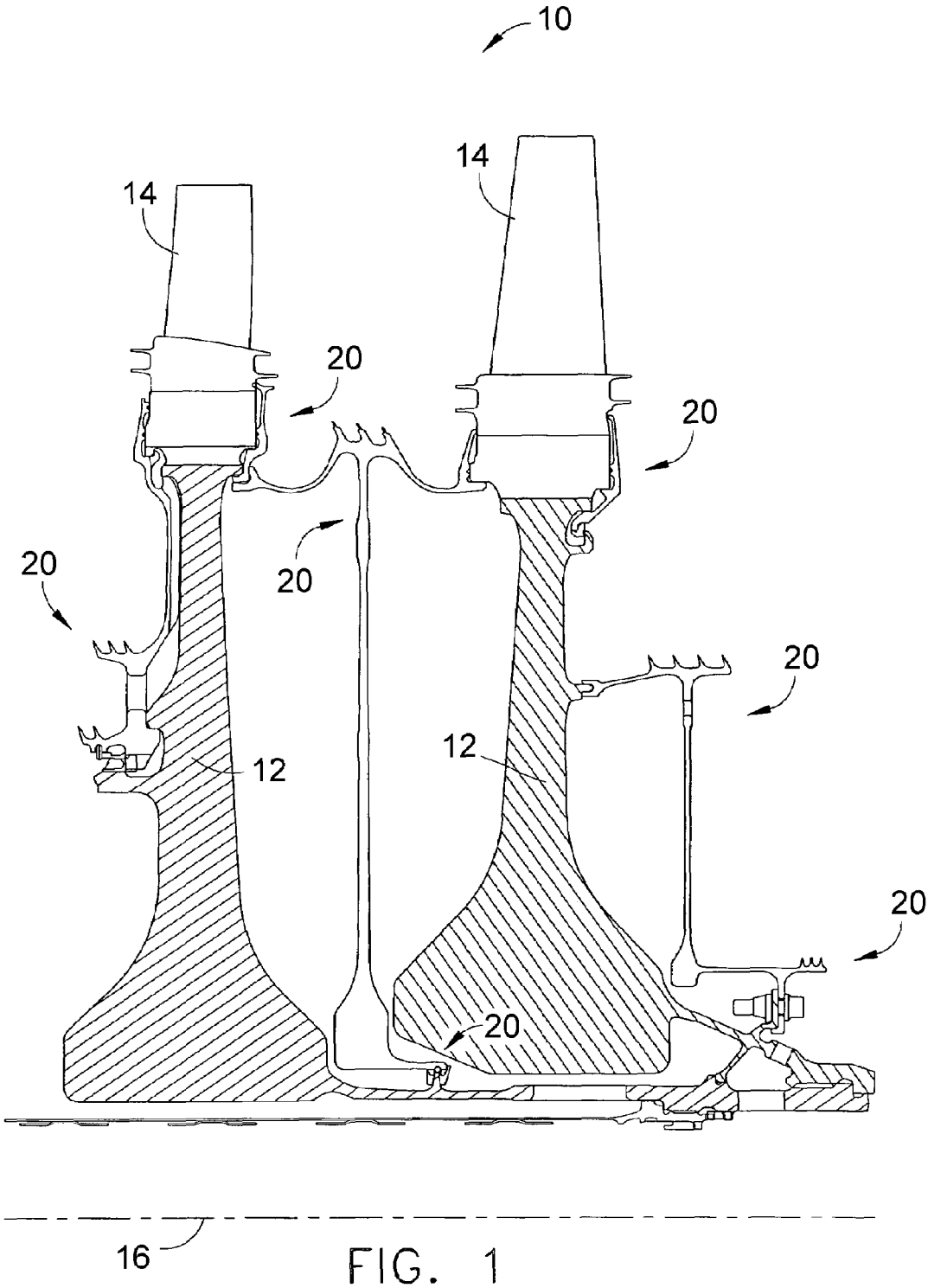
FIG. 1 is a cross-sectional view of a region within a turbine section of a gas turbine engine.

FIG. 1 represents a region within a turbine section 10 of a gas turbine engine. The depicted region contains two disks 12 on which turbine blades 14 are mounted. The disks 12 and their blades 14 rotate about an axis 16, and therefore are rotating components of the turbine section 10. Non-rotating (static) components of the turbine section 10 are not shown in FIG. 1, but are understood to include a shroud that surrounds the disks 12 in close proximity to the tips of the blades 14, and nozzle assemblies disposed between the disks 12 with vanes that direct the flow of combustion gases through the blades 14. Seal elements 20 are shown assembled to the disks 12 and cooperate with surfaces of the static components to form seals that reduce secondary flow losses between the rotating and static components of the turbine section 10. As is common with gas turbine engines and other turbomachinery, the blades 14 (and vanes) may be formed of equiaxed, directionally solidified (DS), or single crystal (SX) superalloys, while the disks 12 and seal elements 20 are formed of polycrystalline superalloys that undergo carefully controlled forging, heat treatments, and surface treatments to achieve desirable grain structures and mechanical properties.

Figure 2:
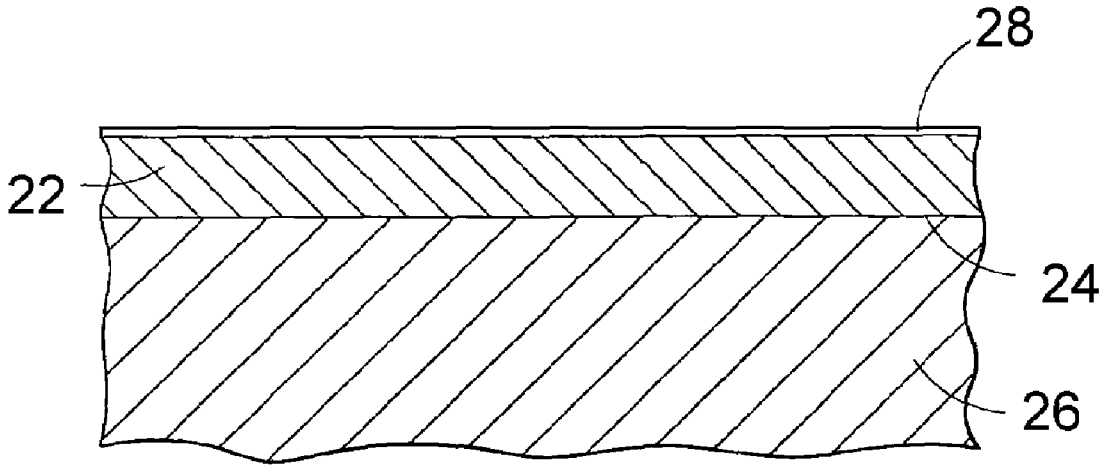
FIG. 2 schematically represents a cross-sectional view of a corrosion and oxidation-resistant environmental coating on a surface of one or more of the turbine components in FIG. 1 according to an embodiment of the invention.

FIG. 2 schematically represents an oxidation and corrosion-resistant environmental coating 22 deposited on a surface region 24 of a substrate 26, which may be any portion of the disks 12 and/or seal elements 20 of FIG. 1. As such, the substrate 26 is formed of a superalloy, typically a nickel, cobalt, or iron-based superalloy of a type suitable for turbine disks and seal elements of gas turbine engines. Particularly suitable superalloys include gamma prime-strengthened nickel-base superalloys such as René 88DT (R88DT; U.S. Pat. No. 4,957,567) and René 104 (R104; U.S. Pat. No. 6,521,175), as well as certain nickel-base superalloys commercially available under the trademarks Inconel®, Nimonic®, and Udimet®. R88DT has a composition of, by weight, about 15.0-17.0% chromium, about 12.0-14.0% cobalt, about 3.5-4.5% molybdenum, about 3.5-4.5% tungsten, about 1.5-2.5% aluminum, about 3.2-4.2% titanium, about 0.5.0-1.0% niobium, about 0.010-0.060% carbon, about 0.010-0.060% zirconium, about 0.010-0.040% boron, about 0.0-0.3% hafnium, about 0.0-0.01 vanadium, and about 0.0-0.01 yttrium, the balance nickel and incidental impurities. R104 has a nominal composition of, by weight, about 16.0-22.4% cobalt, about 6.6-14.3% chromium, about 2.6-4.8% aluminum, about 2.4-4.6% titanium, about 1.4-3.5% tantalum, about 0.9-3.0% niobium, about 1.9-4.0% tungsten, about 1.9-3.9% molybdenum, about 0.0-2.5% rhenium, about 0.02-0.10% carbon, about 0.02-0.10% boron, about 0.03-0.10% zirconium, the balance nickel and incidental impurities.

It is known in the art that a continuous surface layer of a protective oxide, such as chromia ($Cr_2O_3$) or alumina ($Al_2O_3$), is required to provide good corrosion resistance within the hot gas path of a gas turbine engine. Research reported in Goebel et al., "Mechanisms for the Hot Corrosion of Nickel-Base Alloys," Met Trans, 4, 1973, 261, showed that increasing levels of chromium, and as a secondary effect increasing levels of aluminum, promote the formation of a chromia scale with increased corrosion resistance. R. L. Jones, in "Hot Corrosion in Gas Turbines," Corrosion in Fossil Fuel Systems, The Electrochemical Society, Princeton, N.J. (1983), 341-364, proposed that chromium and aluminum contents of at least 15 weight percent and less than 5 weight percent, respectively, are necessary to form a protective chromia scale, and that chromium and aluminum contents of at least 5 weight percent each are necessary to form a protective alumina scale in NiCrAl alloys. However, based on corrosion tests conducted during an investigation leading to the present invention, it was evident that the hot corrosion of a complex superalloy cannot be readily predicted simply based on chromium and aluminum content because of the apparent influence of other alloy elements. In particular, though it was observed that the corrosion performance of turbine disks and seals are particularly affected by certain constituents of the alloys from which they are formed, and the greatest driver in corrosion resistance appeared to be the chromium and/or aluminum contents of the alloys, a clear pattern was not evident. For example, Inconel® 718 (IN718; nominal chromium and aluminum contents of about 19.0 and 0.5 weight percent, respectively) and R88DT (nominal chromium and aluminum contents of about 16.0 and 2.1 weight percent, respectively) meet or exceed the criteria stated in Jones for forming a protective chromia scale but not a protective alumina scale, yet IN718 specimens exhibited the highest corrosion resistance of the alloys tested whereas R88DT specimens exhibited significantly lower corrosion resistances. Furthermore, Inconel® 783 (IN783; nominal chromium and aluminum contents of about 3.0 and 5.5 weight percent, respectively) approaches but does not meet the criteria stated in Jones for forming either a protective chromia or alumina scale, yet on average test specimens formed of IN783 exhibited corrosion resistances nearly as high as IN718. Consequently, it was concluded that small changes in the individual and relative amounts of chromium and aluminum (and possibly other elements) drive the growth of stable continuous oxides on the alloy surface that are relatively inert to corrosion compared to the base alloy.

While the above discussion is specifically directed to corrosion resistance, it is generally understood that oxidation performance will also increase with a more continuous protective oxide scale, such as the chromia and/or alumina scales described above. For example, chromium-rich vapor deposited coatings have long been used to protect oxidation-prone alloys such as the Inconel® 90X series (IN 901, 903, 907, 909).

Auger analysis of corrosion test specimens formed of R88DT and R104 evidenced that their protective oxide scales were complexes of chromia, alumina, and titania ($TiO_2$). It was postulated that a purer protective oxide would be more desirable. According to experience with superalloys used to form turbine blades and MCrAlX overlay coatings used to protect them, oxidation resistance at turbine blade operating temperatures (well in excess of 1600° F. (about 870° C.)) improves with increasing aluminum contents because the operating temperatures of turbine blades cause the formation of the stable alpha-alumina scale, which has a rhombohedral crystal structure and does not undergo phase transformations at elevated temperatures. For this reason, MCrAlX overlay coatings have typically had aluminum contents in excess of 5 weight percent, and often above 10 weight percent. However, intended operating temperatures for turbine disks 12 and seals 20 are far below the operating temperatures of turbine blade alloys and their MCrAlY coatings, generally not greater than 1600° F. (about 870° C.) and typically less than 1500° F. (about 815° C.). At such temperatures, the alumina scale that forms on an aluminum-containing surface is the gamma phase, which has a cubic crystal structure, undergoes phase transformation at elevated temperatures, and is not as slow growing as alpha-phase alumina. Because chromia scale exhibits better forming kinetics at the operating temperatures of turbine disks and seals, it was concluded that a protective chromia scale is preferred over a protective alumina scale.

On the basis of the above, the oxidation and corrosion-resistant environmental coating 22 of the present invention is formulated to contain chromium in an amount that is chemically and physically compatible with the substrate 26, but higher (in atomic percent) than the chromium content of the substrate 26. More particularly, the environmental coating 22 is predominantly a solid solution phase of nickel, iron, and/or cobalt, preferably nickel (gamma-Ni matrix), or cobalt (gamma-Co matrix), or any combination of nickel and cobalt. The chromium content of the coating 22 is about 18 weight percent to about 60 weight percent chromium, with the lower limit of this range ensuring that the coating 22 will form a protective scale 28 that is predominantly chromia, while also exhibiting high ductility, good corrosion resistance, and metallurgically bonding to the substrate 26 for adhesion. Based on the Ni—Cr phase diagram, the upper limit of the chromium range is to avoid the formation of single-phase alpha-chromium intermetallic in the coating. The environmental coating 22 may be as thick as about 250 micrometers, though thicknesses of less than 125 micrometers and more preferably not more than fifty micrometers are preferred so that the coating 22 is sufficiently thin and ductile to enable compressive stresses to be induced in the underlying substrate 26 through shot peening without cracking the coating 22.

The environmental coating 22 as described above is generally a very ductile nickel chromium (NiCr) alloy with excellent corrosion and oxidation resistance and a CTE nearly that of the substrate 26, though with limited strength. The coating 22 is well suited for protecting a turbine disk 12 or seal element 20 because the coating 22 is not required to support a substantial load during operation, and fatigue performance is essentially determined by the underlying substrate 26. In particular, if the substrate 26 is the base metal of a turbine disk 12 or seal element 20, the environmental coating 22 does not adversely impact the fatigue properties of a turbine disk 12 or seal element 20 in that its very high ductility resists crack initiation and its excellent environmental resistance drives crack initiation sites internally within the substrate 26, where grain facets, inclusions, and other common defects are likely to initiate cracking.

The coating 22 may by modified to contain limited amounts of aluminum to promote corrosion resistance. Suitable aluminum levels in the environmental coating 22 are generally in the range of up to about 8 weight percent, such as about 4 to about 8 weight percent, but in inverse proportion to the chromium content of the coating 22. For example, chromium contents of about 18, 35, and 60 weight percent allow for aluminum contents of up to about 8, 6, and 4 weight percent, respectively. The aluminum content of the coating 22 is intentionally less than that required for the onset of beta-phase NiAl formation, which in the NiCrAl system occurs with aluminum contents greater than about 8 weight percent when chromium levels are greater than 13 to 14 weight percent. Beta-phase NiAl is preferably avoided because of its low ductility, which can negatively affect the low cycle fatigue life of a turbine disk 12. However, up to about 10 volume percent of the beta-NiAl phase is believed to be tolerable, as such a level is not continuous and therefore would not be prone to crack propagation. The upper limit for the aluminum content in the environmental coating 22 is also less than the nominal aluminum content for the gamma prime nickel aluminide phase ($Ni_3Al$). As a result, the coating 22 will contain limited amounts of the gamma prime phase if aluminum is present, as long as the environmental coating 22 remains predominantly a solid solution phase.

The oxidation and/or corrosion resistance of the coating 22 can be promoted by optional modifications to the coating 22, such as additions of yttrium, hafnium, silicon, lanthanum, cerium, zirconium, magnesium, and rare earth metals for sulfur gettering, oxide pinning, etc. However, hafnium and silicon should be limited to amounts of less than 5 weight percent, and the remaining elements in this list should be limited to less than 2 weight percent of the environmental coating 22. Though strength is of secondary concern for the coating 22 because load-bearing and fatigue performance are intended to be determined by the underlying substrate 26, the environmental coating 22 may be optionally strengthened with tungsten, molybdenum, tantalum, rhenium, titanium, niobium, vanadium, and/or a platinum group metal (PGM) to improve fatigue resistance. However, additions of these elements are preferably limited to less than 25 weight percent combined, as they can reduce ductility and negatively affect corrosion and oxidation resistance, especially tungsten and molybdenum. With such limited additions, strengtheners can enable the environmental coating 22 to bear some of the load during operation of a turbine disk 12, though maintaining sufficient ductility and environmental resistance to avoid surface-initiated fatigue cracking.

Aside from the elements noted above (and incidental impurities), the balance of the coating 22 is nickel, cobalt, and/or iron, preferably nickel and/or cobalt, in amounts to ensure the coating 22 is predominantly a solid solution phase.

As noted above, because the operating temperatures of turbine disks 12 and seal elements 20 are far below that of turbine blades, whose operating temperatures enable the formation of a stable alpha-alumina scale on an MCrAlX coating, the environmental coating 22 of this invention is formulated to promote the formation of a chromia scale 28, resulting in greater corrosion protection than would be possible if the scale 28 were formed predominantly of alumina. For this reason, a first preferred formulation for the environmental coating 22 contains, by weight percent, less than 4% aluminum, preferably less than 2% aluminum, and more preferably no intentional additions of aluminum beyond incidental impurities to avoid the beta-NiAl phase. In this formulation, the coating 22 contains about 18 to about 60 weight percent chromium, preferably about 18 to about 40 weight percent chromium, and more preferably about 20 to about 30 weight percent chromium. With aluminum being absent or at very low levels in this formulation, the gamma prime phase will at best be present at low levels in the coating 22. Depending on the particular application, it may be necessary or desirable for this first formulation to contain strengthening alloying additions, such as those typically found in superalloys, and particularly the above-noted limited additions of tungsten, molybdenum, tantalum, rhenium, titanium, niobium, vanadium, and/or platinum group metals. Finally, the above-noted optional additions of yttrium, hafnium, silicon, lanthanum, cerium, zirconium, magnesium, and rare earth metals are also possible in this formulation of the coating 22.

A second preferred formulation for the environmental coating 22 contains aluminum in the above-noted range of about 4 to about 8 weight percent, which is sufficient to form the gamma prime phase as well as provide additional environmental protection through the formation of alumina within the scale 28. The coating 22 of this formulation is still desired to contain sufficient chromium to drive the formation of chromia in the scale 28 and achieve a desired level of ductility and corrosion and oxidation resistance. For this reason, suitable and preferred chromium contents for the coating 22 of the second formulation can be the same as that of the first formulation, namely, about 18 to about 60 weight percent chromium, preferably about 18 to about 40 weight percent chromium, and more preferably about 20 to about 30 weight percent chromium. Enough gamma prime phase may be present in the coating 22 to avoid the need or desire for any strengthening alloying additions typically found in superalloys to improve creep and fatigue strength, such as tungsten, molybdenum, tantalum, rhenium, titanium, niobium, vanadium, and/or platinum group metals, and particularly carbon and elements that are detrimental to oxidation resistance, such as iron and titanium. For the chemistry of this formulation, cobalt may be present in an amount of up to about 40 weight percent, more preferably up to about 20 weight percent, to promote resistance to surface cracking under fatigue. Limited additions of silicon, reactive metals (particularly hafnium, yttrium, and zirconium), and/or rare earth metals (particularly lanthanum) as previously discussed are also optional. Finally, carbides, borides, and/or nitrides may also be present in the second formulation of the coating 22 as long as they remain small in size (not larger than those in the substrate alloy) and volume fraction so as not to affect low cycle fatigue life.

The higher strength of the second formulation is believed to be more compatible with high-chromium superalloys that are both precipitate strengthened (Al, Ta, Nb, Ti) and substitutionally-strengthened (W). An example is GTD222 (U.S. Pat. No. 4,810,467), with a preferred composition of, in weight percent, about 22.2-22.8 chromium, about 18.5-19.5 cobalt, about 2.2-2.4 titanium, about 1.1-1.3 aluminum (about 3.2-3.8 titanium+aluminum), about 1.8-2.2 tungsten, about 0.7-0.9 columbium, about 0.9-1.1 tantalum, about 0.005-0.020 zirconium, about 0.005-0.015 boron, about 0.8-0.12 carbon, with the balance being nickel and incidental impurities. The NiCrAl alloy of the second formulation would also be expected to be compatible with the aforementioned R88DT and R104 alloy compositions.

It is worth noting that suitable thicknesses for the environmental coating 22 of this invention can be significantly less than MCrAlX coatings applied to blades, vanes, and other components of gas turbine engines. To controllably limit the thickness of the environmental coating 22, preferred deposition techniques include overlay processes such as chemical vapor deposition (CVD), physical vapor deposition (PVD), atomic layerdeposition (ALD), plating, thermal spraying, etc., and diffusion coating processes known in the art. Each of these coating deposition processes enables the coating 22 to be metallurgically bonded to the substrate 26 through the use of a low temperature diffusion heat treatment, for example, at a temperature of about 1000 to about 1200° F. (about 540 to about 650° C.) for a period of about eight to about twenty-four hours. To promote adhesion, the substrate surface 24 may undergo a mechanical (e.g., grit blasting) and/or chemical pretreatment.

In view of the above, the environmental coating 22 of this invention contains chromium at levels greater than that of the superalloys of the turbine disk 12 and/or seal element 20 to form a protective scale 28 that is predominantly chromia to improve the corrosion and oxidation resistance. Notably, in addition to corrosion protection of concern in the past, the environmental coating 22 also provides greater oxidation resistance to inhibit grain boundary oxidation of the superalloy it protects, thereby promoting the fatigue life of the disk 12 and seal element 20. When applied to gamma prime-strengthened nickel-base superalloys, the NiCr alloy of the invention is believed to have a similar CTE and remain adherent through a strong metallurgical bonding, as well as have limited mechanical property impact and allow surface peening, particularly in view of the relatively high chromium content and/or the limited thickness of the coating 22. Because the composition of the environmental coating 22 is similar to that of the substrate 26 it protects, wear mechanisms are also expected to be similar such that the coating 22 can be used on surfaces subjected to wear from surface-to-surface contact with a surface of another component.

While the invention has been described in terms of one or more particular embodiments, it is apparent that other forms could be adopted by one skilled in the art. Therefore, the scope of the invention is to be limited only by the following claims.

The invention claimed is:

1. A turbine component having a polycrystalline superalloy substrate with a surface subjected to oxidation and corrosion, the surface being protected by an environmental coating metallurgically bonded thereto, the environmental coating being predominantly a solid solution phase, the environmental coating consisting of chromium in an amount of about 18 to about 60 weight percent, wherein said amount of chromium, as measured in atomic percent, is higher than the atomic percent of chromium that may be present in the substrate, optionally aluminum in an amount up to about 8 weight percent, optionally up to a total amount of about 5 weight percent of silicon and/or hafnium, optionally up to a total amount of about 2 weight percent of yttrium, lanthanum, cerium, zirconium, magnesium, and rare earth metals, optionally up to a total amount of about 25 weight percent of tungsten, molybdenum, tantalum, rhenium, titanium, niobium, vanadium, and/or platinum group metals, the balance of the environmental coating being incidental impurities and one or more of nickel, cobalt, and iron in amounts to ensure the environmental coating is predominantly the solid solution phase, wherein the environmental coating optionally contains up to 10 volume percent of beta-NiAl intermetallic phase and has an exterior surface protected with a predominantly chromia scale, and wherein the substrate contains residual compressive stresses induced by shot peening the environmental coating.

2. The turbine component according to claim 1, wherein the environmental coating contains about 18 to about 40 weight percent chromium.

3. The turbine component according to claim 1, wherein the environmental coating contains about 4 to about 8 weight percent aluminum and contains a gamma prime strengthening intermetallic phase.

4. The turbine component according to claim 3, wherein the environmental coating is free of the beta-NiAl intermetallic phase.

5. The turbine component according to claim 3, wherein the environmental coating contains at least one of silicon, hafnium, yttrium, lanthanum, cerium, zirconium, magnesium, and rare earth metals.

6. The turbine component according to claim 3, wherein the environmental coating does not contain tungsten, molybdenum, tantalum, rhenium, titanium, niobium, vanadium, and platinum group metals.

7. The turbine component according to claim 3, wherein the environmental coating contains more than 35 weight percent chromium if the environmental coating contains less than 6 weight percent aluminum, and the environmental coating contains less than 35 weight percent chromium if the environmental coating contains more than 6 weight percent aluminum.

8. The turbine component according to claim 1, wherein the environmental coating contains less than 2 weight percent aluminum.

9. The turbine component according to claim 8, wherein the environmental coating contains aluminum in an amount not exceeding an incidental impurity.

10. The turbine component according to claim 8, wherein the environmental coating is free of the beta-NiAl intermetallic phase and a gamma prime strengthening intermetallic phase.

11. The turbine component according to claim 8, wherein the environmental coating contains at least one of silicon, hafnium, yttrium, lanthanum, cerium, zirconium, magnesium, and rare earth metals.

12. The turbine component according to claim 8, wherein the environmental coating contains at least one of tungsten, molybdenum, tantalum, rhenium, titanium, niobium, vanadium, and platinum group metals.

13. The turbine component according to claim 1, wherein the solid solution phase is gamma-nickel and/or gamma-cobalt.

14. The turbine component according to claim 1, wherein the environmental coating has a thickness of not more than 50 micrometers.

15. The turbine component according to claim 1, wherein the environmental coating has a coefficient of thermal expansion sufficiently similar to that of the substrate to inhibit spallation of the environmental coating.

16. The turbine component according to claim 1, wherein the environmental coating is free of cracks.

17. The turbine component according to claim 1, wherein the environmental coating is an overlay coating.

18. The turbine component according to claim 1, wherein the environmental coating is a diffusion coating.

19. The turbine component according to claim 1, wherein the turbine component is a forged turbine disk.

20. The turbine component according to claim 1, wherein the turbine component is a forged turbine seal element.

21. The turbine component according to claim 1, wherein the substrate of the turbine component is formed of a gamma prime-strengthened nickel-base superalloy having a composition of, by weight, about 15.0-17.0% chromium, 12.0-14.0% cobalt, 3.5-4.5% molybdenum, 3.5-4.5% tungsten, 1.5-2.5% aluminum, 3.2-4.2% titanium, 0.5.0-1.0% niobium, 0.010-0.060% carbon, 0.010-0.060% zirconium, 0.010-0.040% boron, 0.0-0.3% hafnium, 0.0-0.01 vanadium, and 0.0-0.01 yttrium, the balance nickel and incidental impurities.

22. The turbine component according to claim 1, wherein the substrate of the turbine component is formed of a gamma prime-strengthened nickel-base superalloy having a composition of, by weight, about 16.0-22.4% cobalt, about 6.6-14.3% chromium, about 2.6-4.8% aluminum, about 2.4-4.6% titanium, about 1.4-3.5% tantalum, about 0.9-3.0% niobium, about 1.9-4.0% tungsten, about 1.9-3.9% molybdenum, 0.0-2.5% rhenium, about 0.02-0.10% carbon, about 0.02-0.10% boron, about 0.03-0.10% zirconium, balance nickel and incidental impurities.

* * * * *